US009144730B1

(12) United States Patent
Visinski et al.

(10) Patent No.: US 9,144,730 B1
(45) Date of Patent: Sep. 29, 2015

(54) HYBRID REVERSE KINGPIN TRUCK HANGER

(71) Applicant: Surf-Rodz, LLC, Seymour, CT (US)

(72) Inventors: Andrew Visinski, Shelton, CT (US); Josef Visinski, Shelton, CT (US); Wayne Gallipoli, Shelton, CT (US)

( * ) Notice: Subject to any disclaimer, the term of this patent is extended or adjusted under 35 U.S.C. 154(b) by 0 days.

(21) Appl. No.: 14/248,611

(22) Filed: Apr. 9, 2014

Related U.S. Application Data

(60) Provisional application No. 61/810,023, filed on Apr. 9, 2013.

(51) Int. Cl.

| | |
|---|---|
| ***A63C 1/00*** | (2006.01) |
| ***B62M 1/00*** | (2010.01) |
| ***A63C 17/01*** | (2006.01) |
| ***A63C 17/00*** | (2006.01) |

(52) U.S. Cl.
CPC ..... *A63C 17/012* (2013.01); *A63C 17/0093* (2013.01)

(58) Field of Classification Search
CPC . A63C 17/012; A63C 17/0093; A63C 17/011
USPC ..... 280/11.27, 11.28, 87.041, 87.042
See application file for complete search history.

(56) References Cited

U.S. PATENT DOCUMENTS

| | | | | |
|---|---|---|---|---|
| 7,007,957 | B1 * | 3/2006 | Lee | 280/11.28 |
| 7,044,485 | B2 | 5/2006 | Kent et al. | |
| 7,093,842 | B2 * | 8/2006 | Chmelar | 280/87.042 |
| 7,104,558 | B1 | 9/2006 | Saldana | |
| 7,413,200 | B2 * | 8/2008 | Horn | 280/87.042 |
| 7,984,917 | B2 | 7/2011 | Lake et al. | |
| 8,424,882 | B2 * | 4/2013 | Visinski et al. | 280/11.27 |
| 8,500,138 | B2 | 8/2013 | Visinski et al. | |
| 8,888,108 | B1 * | 11/2014 | Beaty et al. | 280/11.27 |
| 2005/0051983 | A1 | 3/2005 | Williams | |
| 2011/0210526 | A1 | 9/2011 | Williams, Jr. | |
| 2012/0068428 | A1 | 3/2012 | Visinski et al. | |
| 2012/0223492 | A1 * | 9/2012 | Ackerman | 280/11.27 |
| 2013/0270781 | A1 * | 10/2013 | Kuyt | 280/11.28 |

* cited by examiner

*Primary Examiner* — John Walters
*Assistant Examiner* — Brian Swenson
(74) *Attorney, Agent, or Firm* — Buckingham, Doolittle & Burroughs, LLC

(57) ABSTRACT

A skateboard truck comprising a hanger pivotably mounted to a base, the hanger having a central aperture extending through opposite sides and a kingpin passing through the hanger central aperture. The truck includes a first and second bushing received on the kingpin, a first bushing seat receiving a portion of one of the first and second bushings and a second bushing seat receiving a portion of the other of the first and second bushings. The first and second bushing seats have different wall configurations. The hanger may be mounted to permit the first bushing to deform, rotating the hanger with respect to the base to a degree when subject to a force offset from the axis of the kingpin. The hanger may be reversibly mounted to permit the first bushing to deform, rotating the hanger with respect to the base to a different degree when subject to the same force.

11 Claims, 5 Drawing Sheets

HYBRID REVERSE KINGPIN TRUCK HANGER

BACKGROUND OF THE INVENTION

1. Field of the Invention

The present invention relates to skateboards and skateboard trucks, and to the hangers used in such trucks.

2. Description of Related Art

Skateboard trucks use resilient, elastomeric bushings, usually two per truck, to provide spring and damping force between the truck base and the hanger carrying the wheels. One bushing is immediately below the truck, between the truck base and the hanger (also known as the truckside bushing), and the other is between the hanger and the kingpin head (also known as the streetside bushing). The truckside bushing primarily provides the flex and springiness of the truck during turning. Some skaters like tighter trucks, while some skaters like looser trucks. In addition to the size, shape and resilience of the bushing, the bushing seat in the hanger of the truck can make all the difference in the way that the trucks ride.

SUMMARY OF THE INVENTION

A restrictive bushing seat for the truckside bushing is one that doesn't allow for much play when turning, giving a much more defined center point. This is considered ideal for downhill, as well as giving a bigger connection to a board, i.e., knowing where it is and how its turning at all times. A disadvantage to a really restrictive bushing seat is that regardless of how "poofy" or soft the bushings are loaded, the trucks will still feel very tight.

Trucks with a loose bushing seat may be considered for all around riding because it can more easily be pumped and carved than a truck with a restrictive bushing seat. However, this gain in versatility with a loose bushing seat is coupled with a loss of that really defined center point, and will lend itself to speed wobbles more easily.

Bearing in mind the problems and deficiencies of the prior art, it is therefore an object of the present invention to provide a skateboard in which the riding characteristics may be easily modified.

It is another object of the present invention to provide a truck for a skateboard in which a portion thereof may be manipulated to change the ride characteristics.

A further object of the invention is to provide a skateboard truck in which the ride characteristics may be modified without changing the bushings.

It is yet another object of the present invention to provide an improved hanger for a skateboard truck which permits the ride characteristics to be easily modified.

Still other objects and advantages of the invention will in part be obvious and will in part be apparent from the specification.

The above and other objects, which will be apparent to those skilled in the art, are achieved in the present invention which is directed to a skateboard truck comprising a base for attachment to a skateboard and a hanger pivotably mounted to the base, the hanger having opposite first and second sides, ends on which wheels may be mounted and a central aperture extending through the opposite sides. The skateboard truck includes a kingpin having a head and a shaft extending therefrom, the shaft passing through the hanger central aperture and secured to the base at an end opposite the head. The skateboard truck includes a first bushing received on the kingpin shaft between the hanger and the base and a second bushing on the kingpin shaft between the hanger and the kingpin head. The skateboard truck includes a first bushing seat on the first side of the hanger having a wall extending below the surface thereof and surrounding the central aperture, and a second bushing seat on the second side of the hanger having a wall extending below the surface thereof and surrounding the central aperture, the first bushing seat receiving a portion of one of the first and second bushings and the second bushing seat receiving a portion of the other of the first and second bushings, the first and second bushing seats having different wall configurations to contact a bushing received therein. The hanger may be mounted to permit the first bushing to be received in and contact the first bushing seat and deform to rotate the hanger with respect to the base to a degree when subject to a force offset from the axis of the kingpin. The hanger may be reversibly mounted to permit the first bushing to be received in and contact the second bushing seat and deform to rotate the hanger with respect to the base to a different degree when subject to the same force offset from the axis of the kingpin. The hanger may have a pivot stem for pivotably mounting the hanger to the truck base wherein the first bushing seat has a diameter at the surface of the hanger first side smaller than a diameter of the second bushing seat at the surface of the hanger second side as measured along a line parallel to the pivot axis. Each bushing seat may have a base inset from the respective side of the hanger wherein the wall of the first bushing seat is continuous and the wall of the second bushing seat is stepped.

Another aspect of the present invention is directed to a skateboard hanger comprising a body having opposite lateral extensions for one or more wheels along an axle axis and an upper end for a pivot stem extending along a pivot axis perpendicular to the axle axis. The skateboard hanger includes opposite sides having faces, a central aperture through the body extending between the faces for receiving a hanger kingpin, and bushing seats having bases inset from and surrounding the central aperture on each face. The bushing seat on one side has a smaller diameter at the face than the bushing seat on the other side at the face as measured along a line perpendicular to the axle axis. The bushing seat on one face may have a smaller cross sectional area than the bushing seat on the other face as measured between their respective bases and hanger faces along a plane that is perpendicular to the axle axis and includes the pivot axis. Each bushing seat may have a wall extending below from the respective side of the hanger to the respective base. The wall of the first bushing seat may be continuous and the wall of the second bushing seat may be stepped.

Another aspect of the present invention is directed to a method of modifying ride characteristics of a skateboard comprising providing a skateboard having a pair of skateboard trucks a skateboard truck comprising a base for attachment to a skateboard and a hanger pivotably mounted to the base, the hanger having opposite first and second sides, ends on which wheels may be mounted and a central aperture extending through the opposite sides. The skateboard truck includes a kingpin having a head and a shaft extending therefrom, the shaft passing through the hanger central aperture and secured to the base at an end opposite the head. The skateboard truck includes a first bushing received on the kingpin shaft between the hanger and the base and a second bushing on the kingpin shaft between the hanger and the kingpin head. The skateboard truck includes a first bushing seat on the first side of the hanger having a wall extending below the surface thereof and surrounding the central aperture, and a second bushing seat on the second side of the hanger having a wall extending below the surface thereof and surrounding the central aperture, the first bushing seat receiving a portion of one of the first and second bushings and the second bushing seat receiving a portion of the other of the first and second bushings, the first and second bushing seats having different wall configurations to contact a bushing received therein. The hanger may be mounted to permit the first bushing to be received in and contact the first bushing seat and deform to rotate the hanger with respect to the base to a degree when subject to a force offset from the axis of the kingpin. The hanger may be reversibly mounted to permit the first bushing to be received in and contact the second bushing seat and deform to rotate the hanger with respect to the base to a different degree when subject to the same force offset from the axis of the kingpin. The method includes riding the skateboard with the hanger in a first position with respect to the first bushing and second bushing, wherein the first bushing seat receives and contacts a portion of the first bushing and the second bushing seat receives and contacts a portion of the second bushing. The method includes placing the hanger in a second position with respect to the first bushing and second bushing, opposite to the first position, wherein the first bushing seat receives and contacts a portion of the second bushing and the second bushing seat receives and contacts a portion of the first bushing. The first bushing deforms and the hanger rotates with respect to the truck base to a different degree when the hanger is in the first position than when the hanger is in the second position, when subject to a same force offset from the axis of the kingpin.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-10 of the drawings in which like numerals refer to like features of the invention.

Figure 1:
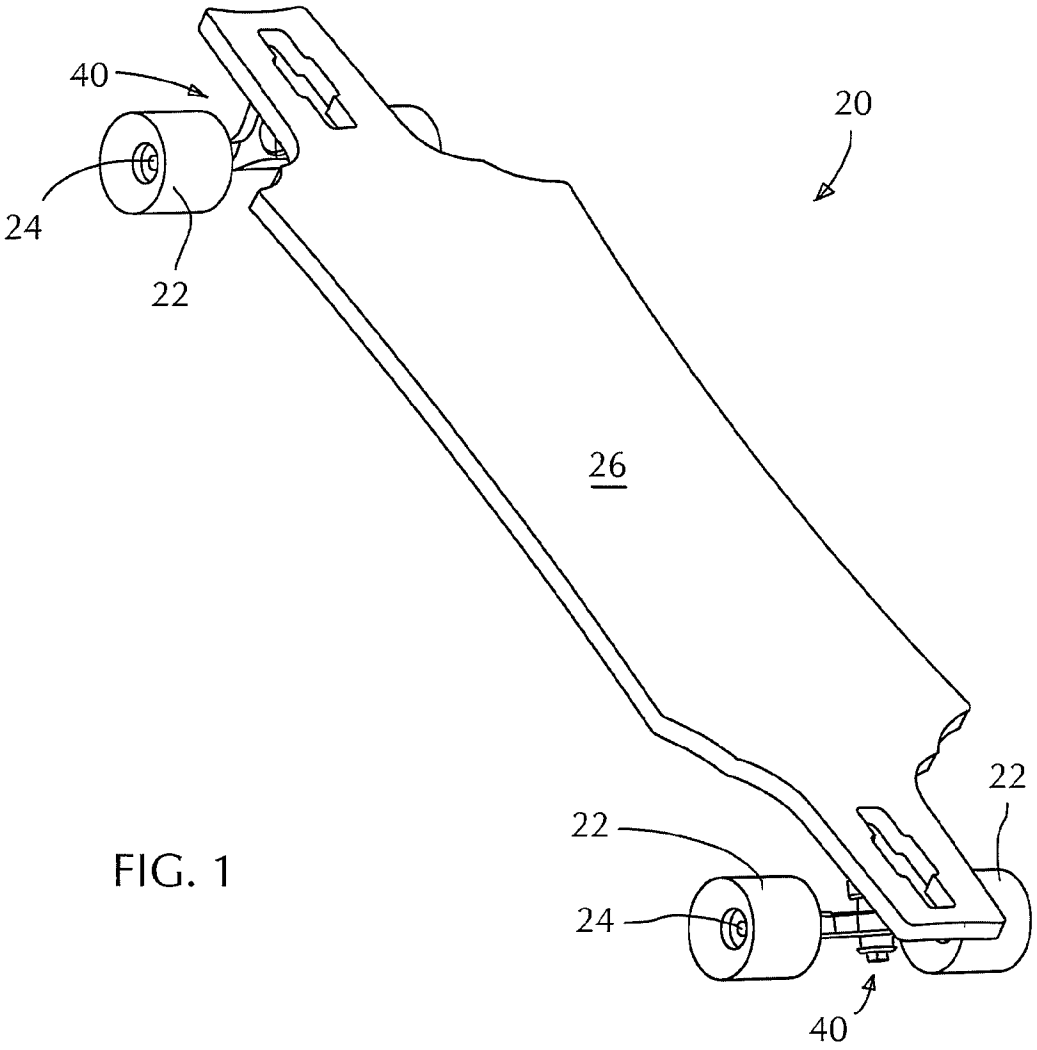
FIG. 1 is a top perspective view of a skateboard with a pair of trucks employing the hybrid reverse kingpin truck hangers of the present invention.
Figure 2:
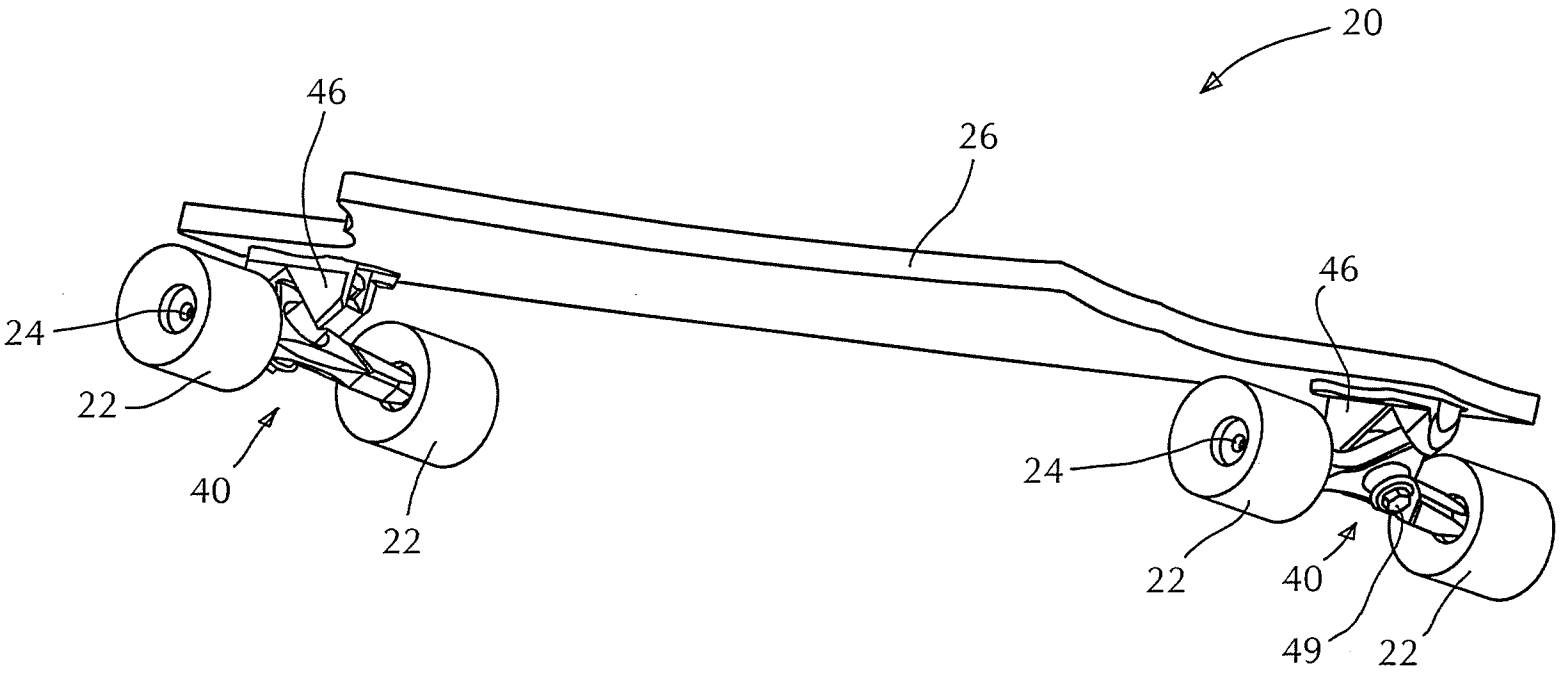
FIG. 2 is a bottom perspective view of the skateboard of FIG. 1.
Figure 3:
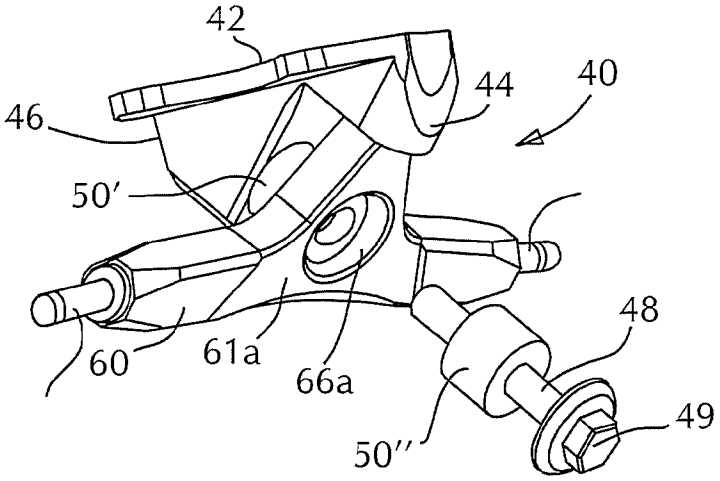
FIG. 3 is an exploded perspective view of an example of a truck employing the hybrid reverse kingpin truck hanger of the present invention.

Skateboard 20 as shown in FIGS. 1 and 2 is supported on opposite ends of the underside of deck 26 by a pair of trucks 40, each carrying a pair of wheels 22 on axles 24. Each truck has a base or support 42 removably securable to skateboard deck 44 by fasteners (not shown), and a pivot mount 44 extending downward from a front portion thereof. In FIG. 3 hanger 60 extends downward and rearward from pivot mount 44, and is secured to the base by kingpin 48 having a head 49 and a shaft extending therefrom, with the kingpin shaft end opposite the head secured to the kingpin mount 46 on the rear of the base. Bushings 50' and 50" are slideably mounted on kingpin 48 on opposite sides of hanger 60.

Figure 5:
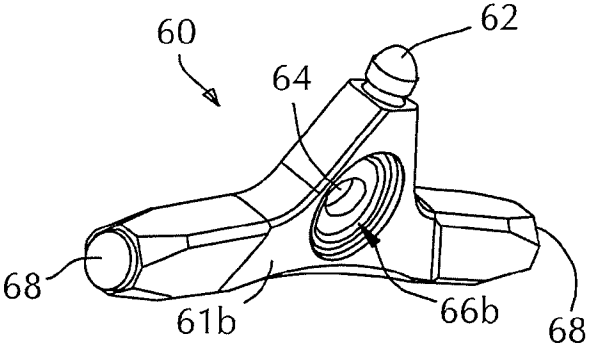
FIG. 5 is a perspective view of the opposite side of the hanger of FIG. 3.
Figure 4:
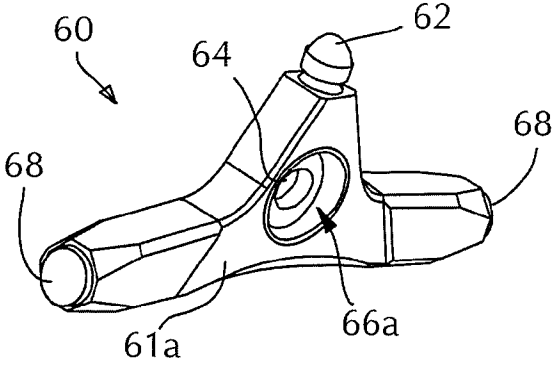
FIG. 4 is a perspective view of one side of the hanger of FIG. 3.
Figure 6:
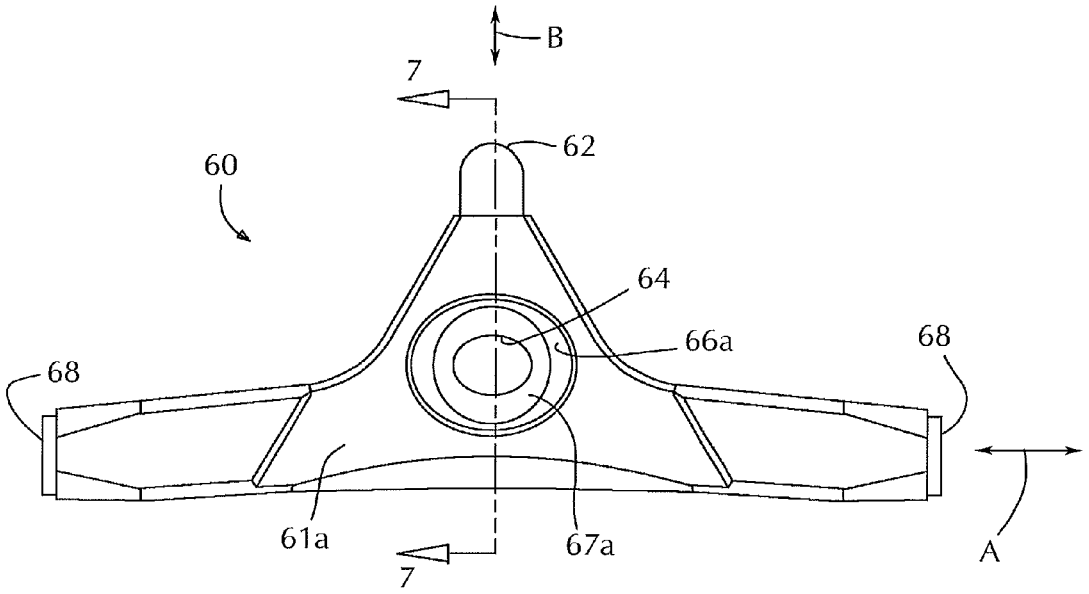
FIG. 6 is a front elevational view of the hanger side of FIG. 4.

As shown in FIGS. 4-6, hanger 60 has a body configured in a generally inverted "T" shape with lateral extensions 69 having ends 68 carrying separate or continuous axles 24 on which wheels 22 are removably mounted. Extending perpendicular to the axle axis A at the hanger upper end is pivot stem 62, which is movably mounted or set in a cup in the pivot mount 44 of hanger base 42 and permits the hanger to pivot in any direction. Between the pivot cup and the axle axis is the kingpin aperture 64 extending through the hanger body, and through which kingpin 48 extends. Aperture 64 may be oval, circular, or any desired configuration. As shown in this example, aperture 64 is oval and has a minor diameter in the direction of axis B of pivot stem 62, and a major diameter in the direction parallel to axle axis A. Surrounding the kingpin aperture on each side of the hangar 60 is a bushing seat 66*a* or 66*b*. The bushing seats are inset in each of the opposed faces and provide a cavity in each side of the hanger to receive a resilient bushing. The bushings are able to compress against the seat sidewalls as the skateboard skater forces the skateboard deck 22 downward on the right or left side to rotate the hanger axle and turn the skateboard. The configuration of the bushing seat determines how much room is allowed for the bushings to deform under compression, allowing for turn/lean. In accordance with the present invention, each side of the hanger has a bushing seat of different configuration.

On one side 61*a* of hanger 60 (FIGS. 4 and 6-8), bushing seat 66*a* has a more restrictive construction wherein in the view along the axis B of the pivot stem (FIGS. 7 and 8) the side walls 70*a* extend substantially straight at an obtuse angle $\alpha$ with respect to the plane of the surface or face of side 61*a*. In this example hanger, in the front view of FIG. 6, bushing seat 66*a* on hanger face 61*a* is of oval configuration, with a smaller, minor diameter in the direction of axis B, and a larger, major diameter parallel to axis A. The bushing seat is oval because restriction in the A direction, parallel to the wheel axis, is less important than restriction in the B direction, along the pivot stem direction. The bushing seat may be circular or other shape, as desired. Whether seen in the view along axis B (FIGS. 7 and 8), or parallel to axis A (not shown), bushing seat 66*a* has larger diameter at the face of side 61*a*, and a smaller diameter at the flat seat base 67*a* set inward from the hanger face.

Figure 7:
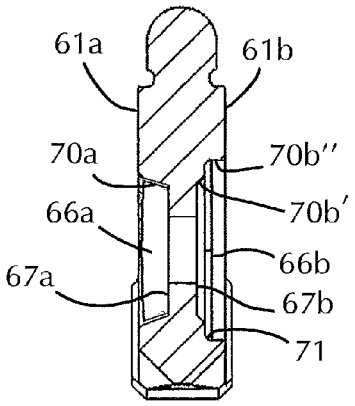
FIG. 7 is a cross sectional view of the hanger of FIG. 6 along lines 7-7.
Figure 8:
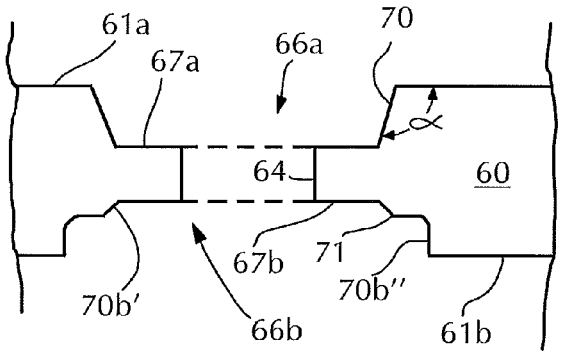
FIG. 8 is a close-up view of the cross section of the bushing seats in the hanger of FIG. 7.

On opposite face 61*b* as shown in FIG. 5, bushing seat 66*b* is of circular configuration, and has two side wall portions, 70*b*' and 70*b*" (FIGS. 7 and 8). Bushing seat 66*b* has a more open construction wherein in the view along the axis B the side walls (FIGS. 7 and 8) extend in a stepped fashion inward from the surface or face of side 61*b*. Side wall portion 70*b*' is located adjacent the inset base 67*b* and has an obtuse angle with respect to the plane of the seat base 67*b* which extends outward from a smaller diameter to a larger diameter at step 71 (FIG. 8). Side wall portion 70*b*" extends inward from hanger face 61*b* and has a larger diameter than the largest diameter of portion 70*b*'. Side wall 70*b*" is shown as being substantially vertical. Alternatively, the side walls 70*b*', 70*b*"

may be continuous at a larger angle than side walls 70*a*, with respect to the plane of hanger face 61*b*.

When seen in the cross sectional view along axis B (FIG. 8), the outer diameter of bushing seat 66*b* is larger than the outer diameter of bushing seat 66*a*. The cavity area of bushing seat 66*a* may be smaller than the cavity area of bushing seat 66*b*, as measured between their respective bases and hanger faces along a plane that is perpendicular to axle axis A and includes pivot axis B. For the same degree of rotation of the hanger with respect to the kingpin 48, this causes a bushing of the same size to be restrained more under compression in the cavity of bushing seat 66*a* than in the cavity of bushing seat 66*b*, since the former has less open area (and volume) than the latter. For the same degree of force exerted by the skater to rotate the hanger and axles, the same bushing will therefore permit less rotation of the hanger when in bushing seat 66*a* than in the cavity of bushing seat 66*b*. Conversely, the same degree of force to rotate the hanger and axles, the same bushing will permit more rotation of the hanger when in bushing seat 66*b* than in the cavity of bushing seat 66*a*.

Figure 9:
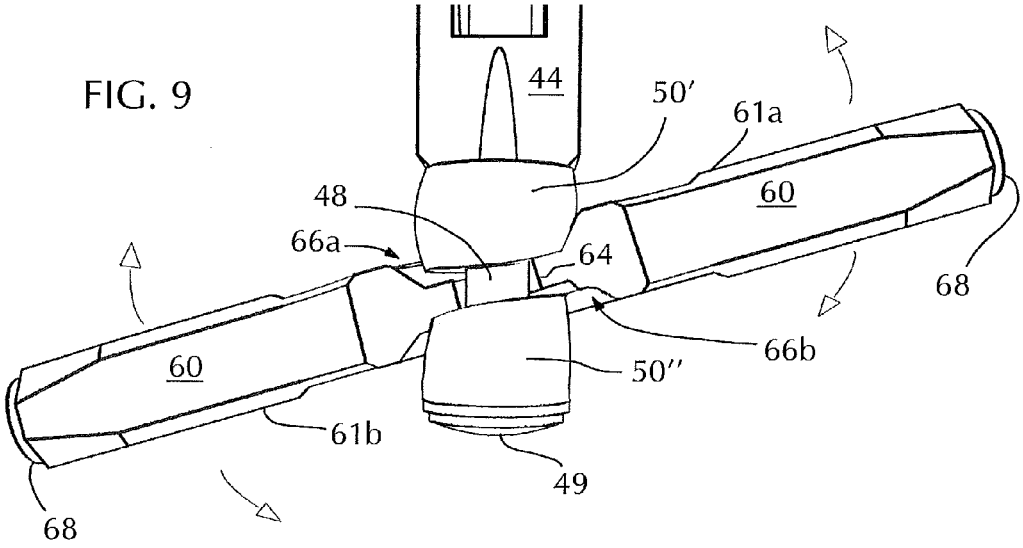
FIG. 9 is a perspective view of a portion of the assembled truck and hanger of FIG. 3.
Figure 10:
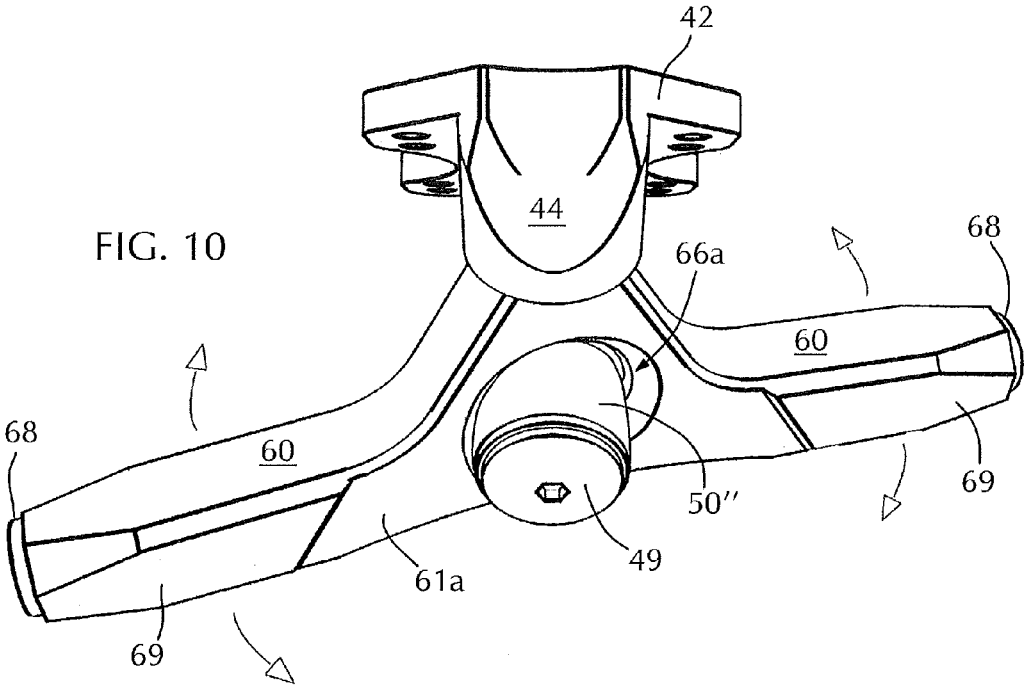
FIG. 10 is another perspective view of a portion of the truck and hanger of FIG. 9.

FIGS. 9 and 10 show hanger 60 mounted by kingpin 48 to pivot mount 44 under the truck base 42. Bushings 50' and 50" are slidably mounted on the kingpin shaft on opposite sides of the hanger. Bushing 50' is fitted on the truck side between hanger 60 and base pivot mount 44, and bushing 50" is fitted on the street side between hanger 60 and kingpin head 49. The bushings may be made from any suitable resilient, elastomeric polymer, such as urethane, polyurethane or silicone. Bushings may have a barrel configuration as shown or they may have any other suitable configuration. Bushing durometer hardness may vary from a soft range of about 87-88 A to a medium range of about 89-90 A to a hard range of 91-92 A, or any other desired degree or range.

In FIG. 9, hanger 60 is positioned with bushing seat 66*a* toward the truck base, and bushing seat 66*b* toward the kingpin head. Bushing set 66*a*, being of more restrictive configuration, has closed in side walls to restrict bushing deformation and expansion in this lateral direction when compressed. Because of the applied forces from the skater's mass, the truck side bushing and bushing seat have more effect on the spring and damping forces in the truck assembly. Therefore, the ride and turn characteristics, when the truck side bushing 50' is set in the more restrictive bushing seat 66*a*, will be more stable and quiet if the skater shifts his mass to apply a force offset from the axis of the kingpin.

In FIG. 10, the hanger is reversed, with bushing seat 66*a* positioned toward the kingpin head, and bushing seat 66*b* toward the truck base. Bushing seat 66*b*, having more open side walls, permits more expansion of bushing 50' (not shown) laterally when it is compressed. Therefore, the ride will be more responsive when the skater shifts his mass. Bushing 50" in restrictive bushing seat 66*a* is subject to less compression, and therefore its position does not affect the responsiveness of the truck assembly.

The reverse kingpin truck of the present invention provides the most versatility, because it offers a variety of lean to turn ratios depending on which way it is mounted. With a combination of the seat design, two seats in one hanger design allow the skater a range of options. When the skater desires to change the ride characteristics, he merely has to remove the kingpin from the truck, reverse the hanger, and re-secure the kingpin with the same bushings in the same position on the truck. The hybrid reverse kingpin truck hangers are versatile and cover a full range from super responsive and "turny," to very stable and quiet, depending on setup.

While bushing choice is important, and the choice of bushing seat (restrictive or more open) allows a user to dial in the range of lean, independent of durometer rating of the bushing. Regardless of the degree of barrel hardness, a more closed, restrictive bushing seat wall will contact the truckside barrel sooner than the more open, less restrictive bushing seat wall. The responsiveness may be further modified from cone-type bushings installed streetside, where the trucks feel super-responsive, to barrel-type bushings, where the trucks quiet down and become super-stable.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A skateboard truck comprising:

a base for attachment to a skateboard;

a hanger pivotably mounted to the base, the hanger having opposite first and second sides, ends on which wheels may be mounted and a central aperture extending through the opposite sides;

a kingpin having a head and a shaft extending therefrom, the shaft passing through the hanger central aperture and secured to the base at an end opposite the head;

a first bushing received on the kingpin shaft between the hanger and the base; a second bushing on the kingpin shaft adjacent each of the hanger and the kingpin head;

a first bushing seat on the first side of the hanger having a wall extending below the surface thereof and surrounding the central aperture, and a second bushing seat on the second side of the hanger having a wall extending below the surface thereof and surrounding the central aperture, the first bushing seat receiving a portion of one of the first and second bushings in direct contact therewith and the second bushing seat receiving a portion of the other of the first and second bushings in direct contact therewith, the first and second bushing seats having different wall configurations to contact a bushing received therein, wherein the hanger may be mounted to permit the first bushing to be received in and contact the first bushing seat and deform to rotate the hanger with respect to the base to a degree when subject to a force offset from the axis of the kingpin, and wherein the hanger may be reversibly mounted to permit the first bushing to be received in and contact the second bushing seat and deform to rotate the hanger with respect to the base to a different degree when subject to the same force offset from the axis of the kingpin.

2. The skateboard truck of claim 1 wherein the hanger has a pivot stem for pivotably mounting the hanger to the truck base and wherein the first bushing seat has a diameter at the surface of the hanger first side smaller than a diameter of the second bushing seat at the surface of the hanger second side as measured along a line parallel to the pivot axis.

3. The skateboard truck of claim 1 wherein each bushing seat has a base inset from the respective side of the hanger, and wherein the wall of the first bushing seat is continuous and the wall of the second bushing seat is stepped.

4. A method of modifying ride characteristics of a skateboard comprising:

providing a skateboard having a pair of skateboard trucks according to claim 1;

riding the skateboard with the hanger in a first position with respect to the first bushing and second bushing, wherein the first bushing seat receives and contacts a portion of the first bushing and the second bushing seat receives and contacts a portion of the second bushing; and placing the hanger in a second position with respect to the first bushing and second bushing, opposite to the first position, wherein the first bushing seat receives and contacts a portion of the second bushing and the second bushing seat receives and contacts a portion of the first bushing, wherein, the first bushing deforms and the hanger rotates with respect to the truck base to a different degree when the hanger is in the first position than when the hanger is in the second position, when subject to a same force offset from the axis of the kingpin.

5. The skateboard truck of claim 1 wherein the central aperture is substantially in the shape of an oval.

6. The skateboard truck of claim 5 further comprising a pivot stem for pivotally mounting the hanger to the truck base and wherein said oval has a minor diameter in a direction substantially parallel to the pivot stem.

7. A skateboard hanger comprising a body having opposite lateral extensions for one or more wheels along an axle axis, an upper end for a pivot stem extending along a pivot axis perpendicular to the axle axis, opposite sides having faces, a central aperture through the body extending between the faces for receiving a hanger kingpin, and bushing seats having bases inset from and surrounding the central aperture on each face, the bushing seat on one side having a smaller diameter at the face than the bushing seat on the other side at the face as measured along a line perpendicular to the axle axis.

8. The skateboard hanger of claim 7 wherein the bushing seat on one face has a smaller cross sectional area than the bushing seat on the other face as measured between their respective bases and hanger faces along a plane that is perpendicular to the axle axis and includes the pivot axis.

9. The skateboard hanger of claim 7 wherein each bushing seat has a wall extending below from the respective side of the hanger to the respective base, and wherein the wall of the first bushing seat is continuous and the wall of the second bushing seat is stepped.

10. The skateboard hanger of claim 7 wherein the central aperture is substantially in the shape of an oval.

11. The skateboard hanger of claim 10 wherein said oval has a minor diameter in a direction substantially parallel to the pivot axis.

* * * * *